US006386282B1

(12) United States Patent
Jänsch

(10) Patent No.: US 6,386,282 B1
(45) Date of Patent: May 14, 2002

(54) SAFETY SWITCHING SYSTEM FOR CLAMPING DEVICES FOR PIPES

(75) Inventor: Manfred Jänsch, Garbsen (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/445,795

(22) PCT Filed: Jun. 20, 1998

(86) PCT No.: PCT/EP98/03779

§ 371 Date: Mar. 7, 2000

§ 102(e) Date: Mar. 7, 2000

(87) PCT Pub. No.: WO99/00577

PCT Pub. Date: Jan. 7, 1999

(30) Foreign Application Priority Data

Jun. 25, 1997 (EP) ..... 97110337

(51) Int. Cl.[7] ..... E21B 19/07

(52) U.S. Cl. ..... 166/53; 166/75.14; 166/77.4; 166/98; 166/382; 254/29 R; 254/30

(58) Field of Search ..... 166/53, 77.1, 77.4, 166/86.1, 88.2, 75.13, 75.14, 98, 381, 382; 254/29 R, 30; 405/249

(56) References Cited

U.S. PATENT DOCUMENTS

| | | | | |
|---|---|---|---|---|
| 2,410,589 A | * | 11/1946 | Segelhorst | 166/75.14 X |
| 2,545,177 A | * | 3/1951 | True | |
| 2,700,201 A | * | 1/1955 | Bannister | 254/30 X |
| 2,829,617 A | | 4/1958 | Kelley | |
| 3,133,469 A | * | 5/1964 | Ljungberg | 254/30 X |
| 4,479,547 A | * | 10/1984 | Boyadjieff et al. | 166/77.4 X |
| 4,595,062 A | * | 6/1986 | Boyadjieff et al. | 254/29 R X |
| 4,676,312 A | | 6/1987 | Mosing et al. | |
| 5,311,937 A | | 5/1994 | Masaki et al. | |
| 5,340,182 A | | 8/1994 | Busink et al. | |
| 5,791,410 A | * | 8/1998 | Castille et al. | 166/77.4 X |
| 5,848,647 A | * | 12/1998 | Webre et al. | 166/75.14 X |

FOREIGN PATENT DOCUMENTS

| | | |
|---|---|---|
| DE | 42 27 645 A1 | 3/1994 |
| EP | 0 589 823 A1 | 3/1994 |
| WO | WO 94/04788 | 3/1994 |

OTHER PUBLICATIONS

International Search Report for PCT/EP/03779, dated Oct. 5, 1998, 3 pages.

* cited by examiner

*Primary Examiner*—George Suchfield
(74) *Attorney, Agent, or Firm*—Moser, Patterson & Sheridan, L.L.P.

(57) ABSTRACT

The invention relates to a safety switching system for a clamping device, provided with clamping wedges and operable by a flowing medium for holding and/or lowering or raising a pipe string, with which a borehole is lined in order to support the rock and create a transport line, characterized in that there is attached to a clamping wedge holder of the clamping device a trip cam for a safety switching valve which is mounted at the basic body of the clamping device and is actively connected to the trip cam when the clamping wedges assume their prescribed clamping position on the pipe string. In another aspect, a safety switching system for use with a string of tubulars may include a clamping device having one or more movable wedges for clamping the tubular; a cam member attached to one of the one or more movable wedges, the cam member movable therewith and includes a switching surface and one or more ramp surfaces, and a safety switch disposed on an adjacent surface, the safety switch constructed and arranged to become actuated by the cam member when the string of tubulars is in a predetermined position within the clamping device.

12 Claims, 3 Drawing Sheets

SAFETY SWITCHING SYSTEM FOR CLAMPING DEVICES FOR PIPES

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

Field of the Invention

Figure 1:
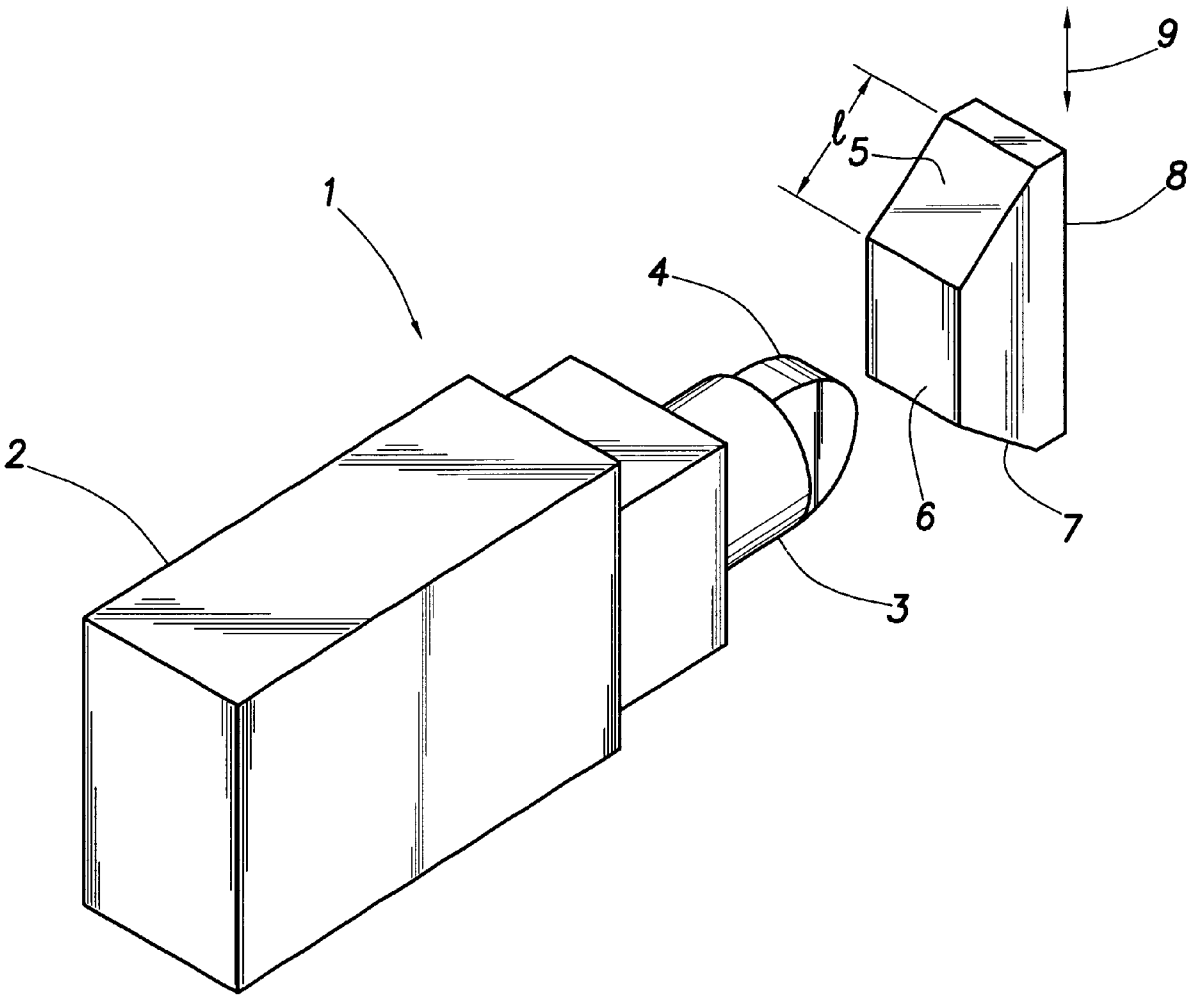

Description of the Related Art including information disclosed under 37 CFR 1.97 and 1.98

The invention relates to a safety switching system for a clamping device, provided with clamping wedges and operable by a flowing medium for holding and/or lowering or raising a pipe string with which a borehole is lined in order to support the rock and create a transport line.

When creating a pipe string and lowering it into a borehole, clamping devices absorbing the considerable inertia forces of the pipe string are alternately used. One of the devices is a holding apparatus (spider), with which a pipe string is held with the help of clamping wedges for screwing to another pipe. For such a holding apparatus, according to U.S. Pat. No. 2,545,177, an apparatus for automatic control of the placing of the clamping wedges is used when the desired position of the pipe string has been reached.

The fitting of an individual pipe onto a pipe string takes place firstly with an auxiliary elevator, which transfers the pipe from a pipe store, places it onto the pipe string and holds it there during the screwing process. After the end of the screwing to the pipe string positioned under the fitted-on pipe, the auxiliary elevator is removed and replaced by the second clamping device, an elevator. This is essentially constructed identically to the holding apparatus and is pushed from above over the initially exposed pipe which is already screwed to the pipe string, until its clamping wedges reach the prescribed position on the pipe. Its clamping wedges are then put in place.

In practice, reaching the correct position on the pipe is difficult. The elevator does not allow a precise observation for determining the correct position of its clamping wedges. For example, gripping part of a pipe sleeve can lead to a slip during the assumption of the very high inertia forces and to considerable damage to the pipe sleeve, as it is to be taken into account that the elevator must hold the entire pipe string at the top end of a screwed-on pipe and lower it as soon as the holding apparatus (spider) is released from the pipe string. This is achieved by the elevator firstly raising the entire pipe string somewhat, to relieve the holding apparatus. Only then can its clamping wedges be released, for example with the help of compressed air. Furthermore, a misunderstanding is to be prevented which causes the holding apparatus (spider) to be opened, although the elevator is not yet closed, and a pipe held by the spider or even a longer pipe string to thereby be lost.

The loss of a pipe string through incorrect use of the elevator or a mis-opening of the spider entails high costs and must therefore be avoided. Therefore, with a safety apparatus according to DE 42 27 645 C2, a possibility was created of placing the clamping wedges of an elevator on the pipe as soon as a pipe sleeve enters the range of a contact switch. This switching device is mounted on the upper side of the elevator. Mechanical influences which can lead to a defect are not to be ruled out however and threaten the necessary high switching security.

BRIEF SUMMARY OF THE INVENTION

The object of the invention is to create a safety switching system of the sort mentioned at the beginning which is arranged protected inside a clamping device, is not subjected to outside mechanical influences and rules out faulty switching with certainty. The invention for achieving this objective is distinguished by the fact that there is attached to the clamping wedge holder of the clamping device a trip cam for a safety switching valve, which is arranged at the basic body of the clamping device and is operable by the trip cam which is moveable with the clamping wedge holder when the clamping wedges assume their prescribed clamping position on the pipe string.

Preferably, the trip cam has a run-on ramp, a run-off ramp and a vertical switching surface located between these and can be traversed by a contact wheel of the switching valve.

The length of the switching surface is determined by the differences in diameter between the largest and the smallest of the pipes to be clamped as prescribed with the clamping device.

For use on an oil-rig using two alternately operable clamping devices (spider and elevator) it is proposed that the safety valve of one device is placed upstream of the control valve for the actuation of the working cylinder for clamping wedges of the other device.

Additionally, a short-circuiting switch is provided for every clamping device to bypass the safety switch. This switch is actuated to be able to introduce a clamping action at the first pipe of a pipe string to be formed.

The use of additional safety valves which reciprocally stop the control cylinders for the opening and closing of the clamping devices becoming active at the same time and accordingly prevent a simultaneous opening of both clamping devices, for example in the case of simultaneously faulty switching, is of further considerable significance as regards safety.

The individual components of the safety switching system are of extraordinary simplicity, developed in a manner customary in the market, and housed in a clamping device so that mechanical defects cannot arise from outside influences. Faulty switchings are ruled out with a high degree of certainty.

BRIEF DESCRIPTION OF THE SEVERAL VIEWS OF THE DRAWING(S)

In the drawing, an embodiment of the invention is schematically portrayed and further explained. These are shown in:

FIG. 1 a sketch illustrating the principle of the safety switch with trip cam.

Figure 2:
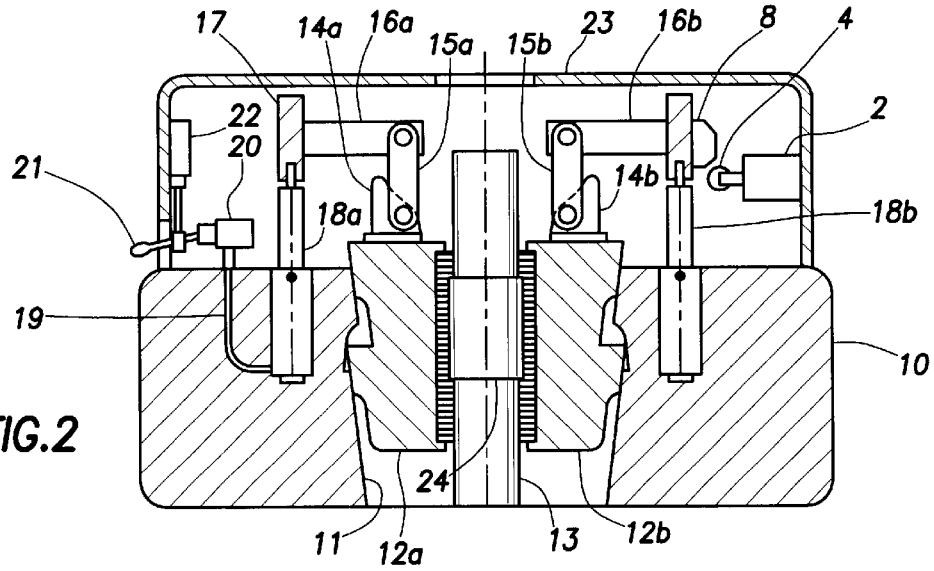

FIG. 2 a cross-section through a clamping device before the start of a clamping process.

Figure 3:
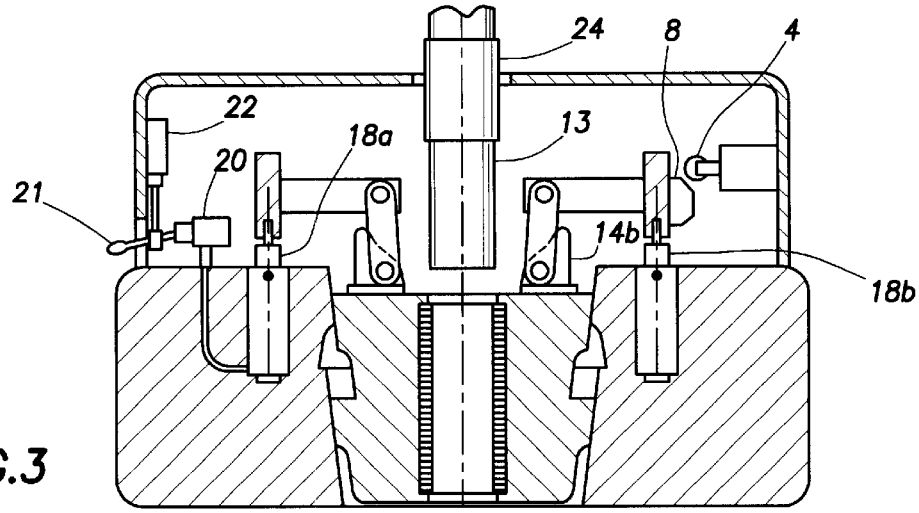

FIG. 3 the clamping device according to FIG. 2 with wedges in place and an incorrect pipe position.

Figure 4:
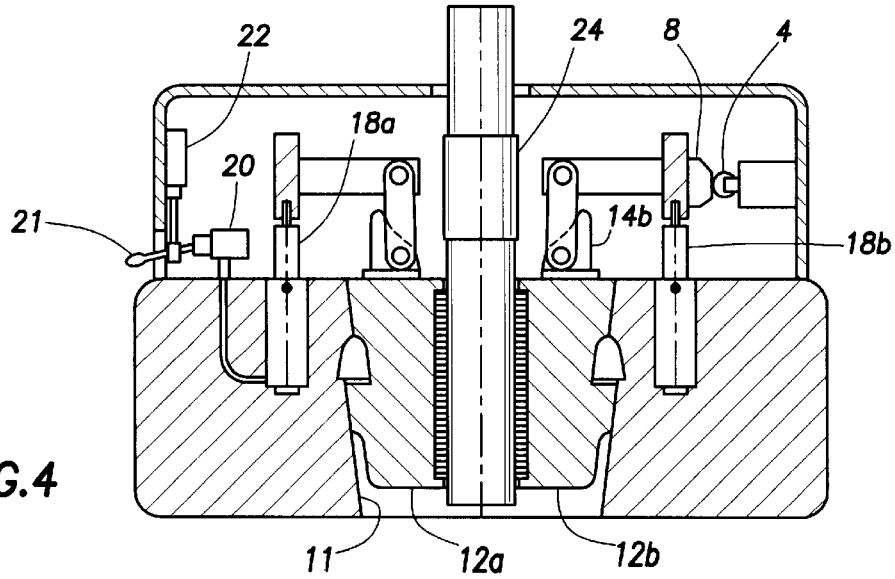

FIG. 4 the clamping device according to FIGS. 2 or 3 with clamping wedges in place after reaching the correct pipe position inside the device.

Figure 5:
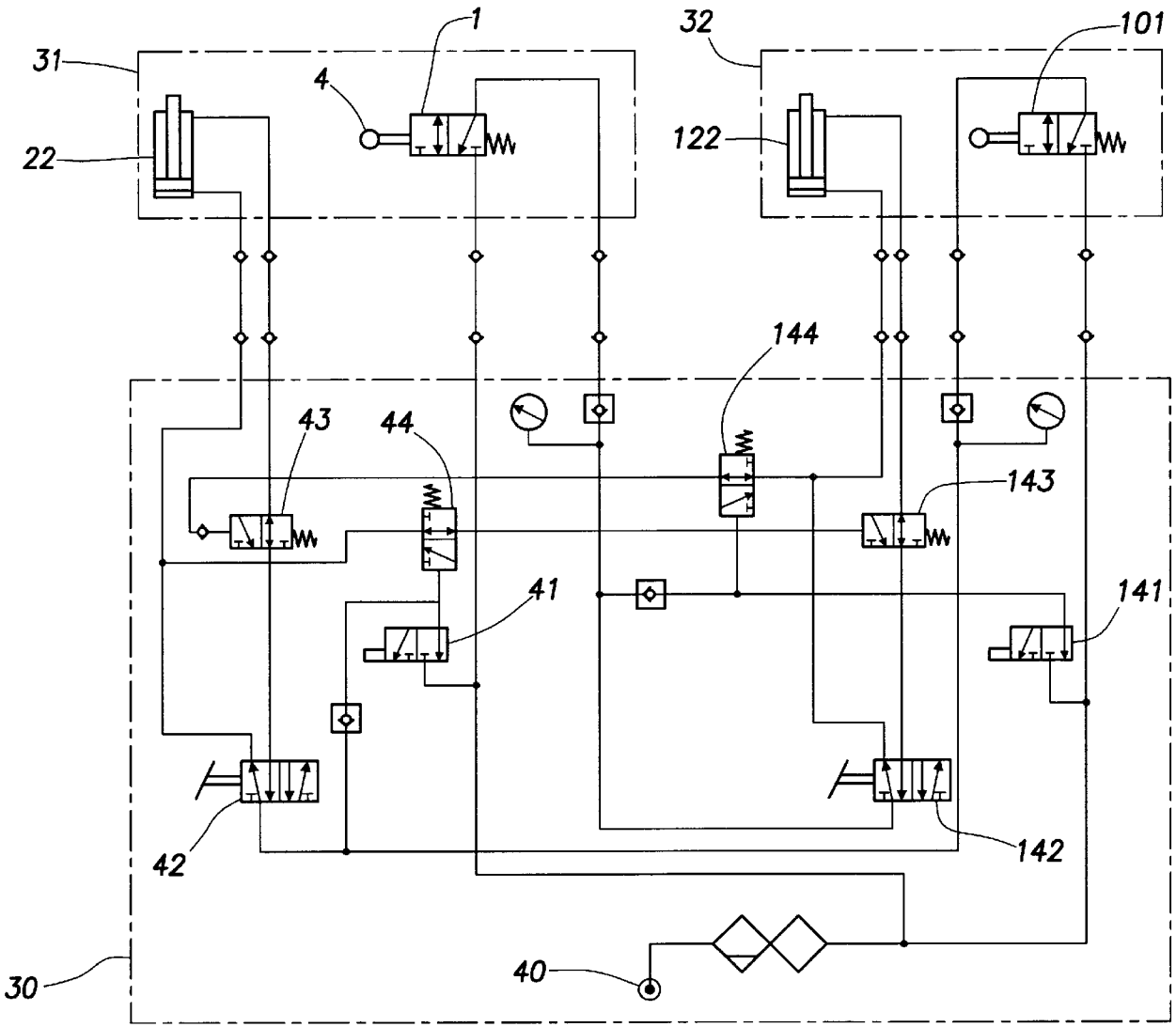

FIG. 5 the wiring diagram for a pneumatically-operated safety switching system.

DETAILED DESCRIPTION OF THE INVENTION

The safety switch 1 with its housing 2 is firmly connected to a clamping device (not shown) and carries, at the front end of holding arm 3, a contact wheel 4 by which the surfaces 5, 6 and 7 of a trip cam 8 can be traversed.

The surfaces 5 and 7 are run-on surfaces for the contact wheel 4 and pass into the switching surface 6. A length "I" of the run-on surfaces 5, 7 is calculated according to the differences in diameter between the largest and the smallest of the pipes (not shown) which are to be clamped by the clamping device in the prescribed way. The cam 8 moves in the direction of the double arrow 9 through its fixed connection to clamping wedges 12*a*, 12*b* of the clamping device and, when actively connected to the touching wheel 4, allows the latter to reach its switching position via the surfaces 5 and 6.

In the embodiment shown according to FIG. 1 the safety switch 1 is not portrayed in the contact position with the trip cam 8 for reasons of better clarity.

Two clamping wedges 12*a* and 12*b* are arranged for example vertically positionable inside a basic body 10 with wedge surfaces 11. Between these wedges there is a section of a pipe string 13 which is to be gripped and clamped by positioning the wedges 12*a*, 12*b*.

The clamping wedges 12*a*, 12*b* are fixed to wedge holders 14*a* and 14*b* and linked to an annular holding member 17 via power-transmission bars and connectors 16*a* and 16*b*. The annular holding member 17 is vertically adjusted via positioning units consisting of working cylinders and positioning pistons 18*a* and 18*b*. The positioning units 18*a*, 18*b* can be both pneumatically and hydraulically actuated. A feed line for the medium is indicated for example by 19. The feed 19 is controlled via a working valve 20, whose actuation lever 21 is mechanically connected to a control cylinder 22. A protective cover 23 on the base 10 very largely seals off the entire apparatus to the outside.

FIG. 2 shows a part of the pipe string 13 with a pipe sleeve 24 inside the still opened clamping wedges 12*a*, 12*b*. However, the greater diameter of the tube sleeve 24 prevents the positioning of the clamping wedges 12*a* and 12*b* in their prescribed position. The trip cam 8 will not thus reach the contact wheel 4 of the safety switch 1. The same effect will come about with a clamping process with a pipe 13 which is positioned in the prescribed way, but has too great a dimension.

Another incorrect position of the pipe string 13 inside a clamping device is shown in FIG. 3. The pipe string 13 to be clamped has not reached the clamping wedges 12*a* and 12*b*. Upon actuating of the positioning units 18*a* and 18*b*, the clamping wedges 12*a*, 12*b* can therefore be quickly lowered to the bottom end of the wedge surface 11. The trip cam 8 thereby runs quickly past the contact wheel 4, so that there is no effective switching process, to be triggered by the safety switch 1, which releases the positioning units of the second clamping device (not shown). The effect will be the same in a clamping process with a pipe 13 which is correctly positioned but has too small a diameter.

FIG. 4 shows the pipe string 13 in the prescribed clamping position inside the clamping device. The clamping wedges 12*a*, 12*b* grip the pipe string 13 underneath the connection sleeve 24. The clamping wedges 12*a*, 12*b* can carry out the clamping process with the help of the positioning units 18*a* and 18*b* and in doing so assume their prescribed position within the clamping wedge surface 11. With the lowering of the clamping wedges 12*a* and 12*b*, the trip cam 8 fixed to the holding member 14*b* of the clamping wedge 12*b* enters the range of the contact wheel 4 and presses it against the housing 2 of the safety switch 1. The contact wheel 4 is actively connected to the holding surface 6 of the trip cam 8, this not being able to be moved further down so that the contact wheel 4 always lies against the holding surface 6 and raises the locking device above the control cylinder of the second clamping device (not shown) so that this can release the pipe string 13.

The switching elements provided for the desired automatic running of the working processes on an oil rig with a holding apparatus (spider) 31 and a lowering and a raising apparatus (elevator) 32 are contained within a switch box 30 (FIG. 5). The corresponding connection lines lead from the switch box 30 to the safety valves 1 and 101 on the holding device 31 and on the lowering and raising apparatus (elevator) 32 as well as to the corresponding control cylinders 22 and 122, which are each located on the devices. The components of the entire safety system will be explained in the following by reference to the individual process steps with the beginning of a screwing process. For the sake of simplicity, the lowering and the raising device 32 is given the customary name "elevator" and the holding device 31 the name "spider" as is customary in the industry.

The entire apparatus is supplied with compressed air via the pressure source 40. Firstly, the spider 31 and the elevator 32 are closed. The safety bypass valve 41 for the spider 31, which is closeable by hand, is opened. The identical safety bypass valve 141 for the elevator 32 can remain closed. Thereupon the actuation valve 42 for the spider 31 trips. This opens the spider 31. With an auxiliary elevator (not shown), a pipe (not shown) can be threaded into the spider 31. The spider 31 is then closed via the actuation valve 42, assuming the trip cam (not shown) reaches and maintains its switching position. The safety bypass valve 41 is then switched off and secured, whereby the safety system is switched on via the safety switch 1.

A further pipe (not shown) is fitted onto the pipe held in the spider 31 with the auxiliary elevator and screwed on. The opened elevator 32 can then be pushed over the screwed-on pipe. By pressing the actuation switch 142, the elevator 32 closes over the control cylinder 122 and clamps the screwed-on pipe. The safety switch 101 on the elevator 32 is activated via the trip cam. Thereby, the mediums' path to the actuation valve 42 is freed.

The spider 31 can then be opened by pressing the actuation valve 42. The associated trip cam 8 leaves the switching position on the safety valve 1. The medium to the actuation valve 142 is blocked off and emptied. The elevator 32 can now lower the pipe string formed by the first two screwed pipes into the desired position. The switch 42 is then actuated again, whereby the control cylinder 22 is activated and the spider 31 closes. After the trip cam has reached its prescribed position, the safety switch 1 clamps again, so that the elevator 32 is freed for opening again.

The valves 43 and 143 are safety valves which reciprocally prevent the control cylinders 22 and 122 from being able to be actuated simultaneously and the clamping wedges 12*a*, 12*b* thereby released from the spider 31 and elevator 32 simultaneously.

The two valves 43, 143 can be blocked by shut-off valves 44 and 144 on order to be able to introduce a working procedure with the housing of the first pipes in the spider 31 and elevator 32.

What is claimed is:

1. A safety switching system for a clamping device, provided with clamping wedges and operable by a flowing medium for holding and/or lowering or raising of a pipe string, with which a borehole is lined in order to support rock and create a transport line, characterized in that there is attached to a clamping wedge holder (14*a*, 14*b*) of the clamping device a trip cam (8) for a safety switching valve (1) which is mounted at the basic body (10) of the clamping device and is actively connected to the trip cam when the clamping wedges assume their prescribed clamping position on the pipe string, thereby maintaining the clamping wedges in their prescribed clamping position.

2. The safety switching system according to claim 1 for use on an oil rig using two alternately actuatable clamping devices, characterized in that the safety switching valve of a lowering and a raising device is placed upstream of the control valve for the actuating of the working cylinder for clamping the wedges of a holding device.

3. The safety switching system according to claim 1, wherein the trip cam (8) includes a run-on ramp, a run-off ramp and a vertical switching surface (6) situated between them and can be traversed by a contact wheel (4) of the safety switching valve.

4. The safety switching system according to claim 3, wherein the length (1) of the run-on (5) and run-off ramp (7) is determined by the difference in diameter between the largest and the smallest of the pipes which can be clamped by the clamping device.

5. The safety switching system according to claim 2, characterized in that a bypass switching valve (41, 141) is provided for every clamping device to bypass the safety switch.

6. The safety switching system according to claim 2, characterized in that safety valves (43, 143) are placed upstream of the control cylinders (22, 122) for positioning the clamping wedges of the two clamping devices, in such a way that, upon actuation of the control cylinder of one clamping device, the control cylinder of other device is blocked.

7. The safety switching system according to claim 6, characterized in that shut-off valves (44, 144) are placed upstream of the safety valves (43, 143) for the switching off of the safety valves and the shut-off valves can be operated by the actuation of the bypass valves (41, 141) for the bypassing of the safety switches.

8. The safety switching system according to claim 6, characterized in that the safety valves (43, 143) and shut-off valves (44, 144) are provided with return springs for automatic repositioning after a relieving of pressure.

9. The safety switching system according to claim 1 for use on an oil rig using two alternately actuatable clamping devices, characterized in that the safety switching valve of a holding device is placed downstream of the control valve for the actuating of the working cylinder of a lowering and raising device.

10. A safety switching system for use with a string of tubulars, the system comprising:

a clamping device having one or more movable wedges disposed therein for clamping the tubular string;

a cam member attached to one of the one or more movable wedges, the cam member movable therewith and including a switching surface and one or more ramp surfaces; and a safety switch disposed on an adjacent surface, the safety switch constructed and arranged to become actuated by the cam member when a predetermined diameter of the string of tubulars is within the clamping device.

11. The safety switching system of claim 10, wherein a length of the one or more ramp surfaces is determined by a difference between a first diameter and a second diameter of the string of tubulars.

12. The safety switching system of claim 10, wherein actuating the safety switching system comprises moving the cam to a position whereby the cam is in contact with the switching surface.

* * * * *

UNITED STATES PATENT AND TRADEMARK OFFICE

CERTIFICATE OF CORRECTION

PATENT NO. : 6,386,282 B1
DATED : May 14, 2002
INVENTOR(S) : Jänsch

It is certified that error appears in the above-identified patent and that said Letters Patent is hereby corrected as shown below:

Column 5,
Line 20, please change “length (1)” to -- length (I) --.

Signed and Sealed this

Twenty-ninth Day of July, 2003

JAMES E. ROGAN
*Director of the United States Patent and Trademark Office*